US007152425B2

(12) United States Patent
Han et al.

(10) Patent No.: US 7,152,425 B2
(45) Date of Patent: Dec. 26, 2006

(54) BLOWING DEVICE AND AIR CONDITIONING APPARATUS HAVING THE SAME

(75) Inventors: Jae Oh Han, Seoul (KR); Weon Seok Choi, Suwon-Si (KR); Jin Baek Kim, Suwon-Si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/853,198

(22) Filed: May 26, 2004

(65) Prior Publication Data

US 2005/0086973 A1 Apr. 28, 2005

(30) Foreign Application Priority Data

Oct. 22, 2003 (KR) ..... 10-2003-0073926

(51) Int. Cl.
*F25D 17/06* (2006.01)

(52) U.S. Cl. ..... 62/419

(58) Field of Classification Search ..... 62/419, 62/407, 259.1, 426; 454/301
See application file for complete search history.

(56) References Cited

U.S. PATENT DOCUMENTS 4,085,881 A * 4/1978 Roberson ..... 226/95
4,202,296 A * 5/1980 Nonnenmann et al. .. 123/41.48
4,908,050 A * 3/1990 Nagashima et al. ..... 55/400
RE34,154 E * 1/1993 Lee ..... 62/285
5,511,939 A * 4/1996 Tokunaga et al. ..... 415/206
5,577,958 A * 11/1996 Kumekawa et al. ..... 454/233
5,626,066 A * 5/1997 Lallement ..... 83/451
6,470,699 B1 * 10/2002 Okuda et al. ..... 62/259.2
6,481,237 B1 * 11/2002 Kim ..... 62/407
6,591,516 B1 * 7/2003 Kamada et al. ..... 34/97
6,698,916 B1 * 3/2004 Araoka ..... 366/264

FOREIGN PATENT DOCUMENTS

GB 2352509 A * 1/2001
JP 63-224712 A * 9/1988
JP 2000-039199 A 2/2000
JP 2001-115991 A * 4/2001
JP 2003-003997 A 1/2003
JP 2003-097821 A 4/2003
KR 2000-55690 A 9/2000

* cited by examiner

*Primary Examiner*—Mohammad M. Ali
(74) *Attorney, Agent, or Firm*—Sughrue Mion, PLLC

(57) ABSTRACT

A blowing device having an air suction guide with an improved structure to reduce blowing operational noise, and an air conditioning apparatus having the blowing device. The blowing device includes a blowing fan, a fan casing placed to cover the blowing fan and having a suction port, and a suction guide provided in the suction port of the fan casing to guide inlet air to the blowing fan. The suction guide includes a flow guide part extending forward from an edge of the suction port of the fan casing by a predetermined length. Due to the flow guide part of the blowing device, the inlet air flows through the suction port at a constant flowing speed and in a state of laminar flow. Therefore, the blowing device reduces a variation in a pressure applied onto blades of the blowing fan by the inlet air, and reduces operational noise thereof.

8 Claims, 3 Drawing Sheets

BLOWING DEVICE AND AIR CONDITIONING APPARATUS HAVING THE SAME

CROSS-REFERENCE TO RELATED APPLICATION

This application claims the benefit of Korean Patent Application No. 2003-73926, filed Oct. 22, 2003 in the Korean Intellectual Property Office, the disclosure of which is incorporated herein by reference.

BACKGROUND OF THE INVENTION

1. Field of the Invention

Apparatuses consistent with the present invention relate, in general, to blowing devices and air conditioning apparatuses having the blowing devices and, more particularly, to a blowing device having an air suction guide with an improved structure to reduce operational noise of the blowing device, and to an air conditioning apparatus having the blowing device.

2. Description of the Related Art

Generally, air conditioning ducts and air conditioning apparatuses are typically provided with blowing devices which are disclosed in, for example, Japanese Patent Laid-open Publication Nos. 2000-39199 and 2003-3997. The above-mentioned conventional blowing devices for air conditioning ducts or air conditioning apparatuses include a centrifugal-type blowing fan having a plurality of blades, a motor to drive the blowing fan, and a fan casing which covers the blowing fan and guides inlet air to the blowing fan. The fan casing of the conventional blowing devices has a suction port to draw the air into the fan casing, and an exhaust port to discharge the air from the fan casing to an outside of the fan casing. The fan casing further includes an air suction guide which is provided in the suction port of the fan casing to guide the inlet air to the blowing fan. In the related art, the air suction guide provided in the fan casing is a so-called "bell mouth".

In the conventional blowing devices, the suction port of the fan casing has a variable inner diameter which is gradually reduced in a direction from an inlet end of the suction port toward the blowing fan, thus providing the air suction guide having a smoothly rounded surface to guide evenly the inlet air to the blowing fan.

However, the conventional blowing device having the above-mentioned air suction guide is problematic as follows. During an operation of the conventional blowing device, the inlet air flows through a peripheral area of the suction port, which is adjacent to the air suction guide, at a speed which is higher than a flowing speed of the inlet air flowing through a central area of the suction port while the inlet air flows to the blowing fan through the suction port due to a suction force generated by the blowing fan. Therefore, a flow rate of the inlet air flowing through the peripheral area of the suction port is higher than a flow rate of the inlet air flowing through the central area of the suction port, so that the conventional blowing device increases an amount of inlet air flowing into the fan casing. However, there is a remarkable variation in a pressure applied onto the blades of the blowing fan by the inlet air, thus the conventional blowing device generates operational noise which upsets those around the blowing device.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Accordingly, it is an aspect of the present invention to provide a blowing device, in which a peripheral area of a suction port adjacent to an air suction guide is structured to reduce a flowing speed of inlet air flowing through the peripheral area of the suction port, thus reducing a variation in a pressure applied onto blades of a blowing fan by the inlet air and reducing operational noise of the blowing device caused by the variation in the pressure.

It is another aspect of the present invention to provide an air conditioning apparatus having the above-mentioned blowing device.

Additional aspects and/or advantages of the invention will be set forth in part in the description which follows and, in part, will be understood from the description, or may be learned by practice of the invention.

The above and/or other aspects are achieved by providing a blowing device, including: a blowing fan; a fan casing placed to cover the blowing fan and having at least one suction port; and a suction guide provided in the suction port of the fan casing to guide inlet air to the blowing fan, the suction guide including a flow guide part extending forward from an edge of the suction port of the fan casing by a predetermined length.

The suction guide may further include: a rounded part to guide the inlet air from the suction port to the blowing fan, the rounded part having a variable inner diameter which is gradually reduced in a direction from the suction port toward the blowing fan, wherein the flow guide part extends forward from the rounded part.

The flow guide part may have an inner diameter which is larger than a minimum inner diameter of the rounded part.

The flow guide part may have an inner diameter which is equal to the minimum inner diameter of the rounded part.

The above and/or other aspects are achieved by providing an air conditioning apparatus, including: a cabinet provided with a heat exchanger therein; a blowing device including: a blowing fan provided in the cabinet; and a fan casing placed to cover the blowing fan and having at least one suction port; and a suction guide provided in the suction port of the fan casing to guide inlet air to the blowing fan, the suction guide including a flow guide part extending forward from an edge of the suction port of the fan casing by a predetermined length.

BRIEF DESCRIPTION OF THE DRAWINGS

These and other aspects and advantages of the invention will become apparent and more readily appreciated from the following description of the illustrative, non-limiting embodiments, taken in conjunction with the accompanying drawings, in which.

DETAILED DESCRIPTION OF ILLUSTRATIVE, NON-LIMITING EMBODIMENTS OF THE INVENTION

Figure 1:
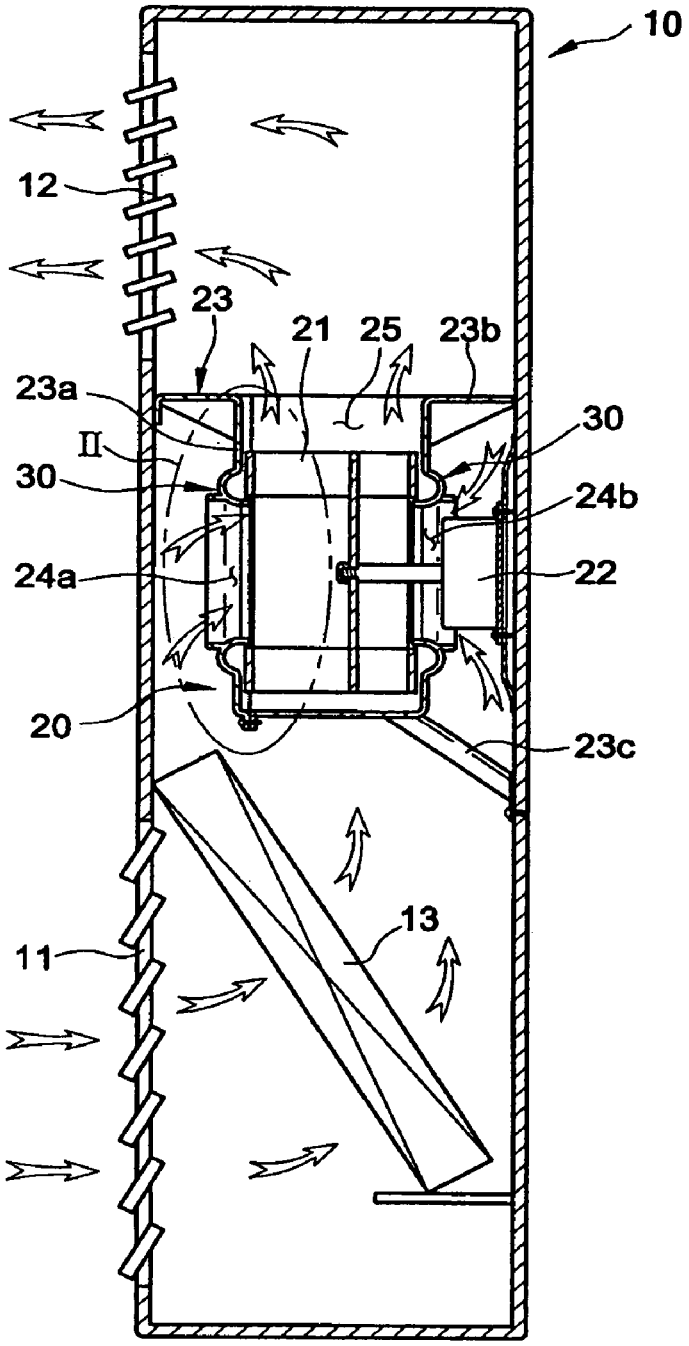
FIG. 1 is a sectional view of an air conditioning apparatus having a blowing device according to a first exemplary embodiment of the present invention.

Reference will now be made in detail to the illustrative, non-limiting embodiments of the present invention, examples of which are illustrated in the accompanying drawings, wherein like reference numerals refer to like elements throughout. The embodiments are described below in order to explain the present invention by referring to the figures.

FIG. 1 is a sectional view of an air conditioning apparatus having a blowing device 20 according to a first embodiment of the present invention. As shown in FIG. 1, the air conditioning apparatus of the present invention includes a box-shaped cabinet 10 which is provided with both a heat exchanger 13 and the blowing device 20 therein. The heat exchanger 13 absorbs or transfers heat from or to room air which is introduced into and circulates in the cabinet 10, thus the heat exchanger 13 reduces or increases a temperature of the room air, prior to discharging the room air from the cabinet 10 to a room. The blowing device 20 generates a suction force to introduce the room air into the cabinet 10, and allow the room air to circulate in the cabinet 10. The cabinet 10 further includes an air inlet grill 11 which is provided at a lower portion of a front panel of the cabinet 10 to introduce the room air from the room into the cabinet 10. The cabinet 10 further includes an air outlet grill 12 which is provided at an upper portion of the front panel of the cabinet 10 to discharge the room air from the cabinet 10 to the room, after the room air is cooled or heated by the heat exchanger 13.

The blowing device 20 provided in the cabinet 10 forcibly circulates the room air, which has been introduced into the cabinet 10 and has passed through the heat exchanger 13, to the air outlet grill 12. The blowing device 20 includes, for example, a centrifugal-type blowing fan 21 having a plurality of blades 21*a* (see FIG. 2), a motor 22 mounted to an inner surface of the cabinet 10 to drive the blowing fan 21, and a fan casing 23 which covers the blowing fan 21 and guides the inlet room air to the blowing fan 21.

The fan casing 23 of the blowing device 20 includes a cylindrical casing body 23*a* to receive the blowing fan 21 therein, with a partition wall 23*b* installed at an upper portion of the fan casing 23 to divide an interior of the cabinet 10 into upper and lower spaces. The fan casing 23 further includes a support leg 23*c* which supports a lower portion of the casing body 23*a* to the inner surface of the cabinet 10. The fan casing 23 of the blowing device 20 further includes front and rear suction ports 24*a* and 24*b* which are provided on the fan casing 23 in front of and in back of the blowing fan 21, thus the inlet room air is drawn to the blowing fan 21 backward and forward. The fan casing 23 further includes an exhaust port 25 which is provided at a top of the fan casing 23. Thus, the inlet room air is discharged from the fan casing 23 to the air outlet grill 12 of the cabinet 10. The blowing device 20 of the present invention further includes front and rear air suction guides 30 which are respectively provided in each of the front and rear suction ports 24*a* and 24*b* to guide the inlet room air drawn into the fan casing 23 through the front and rear suction ports 24*a* and 24*b*. In the first embodiment of the present invention, the front and rear air suction guides 30 are integrated with the casing body 23*a* of the fan casing 23 into a single structure.

Figure 2:
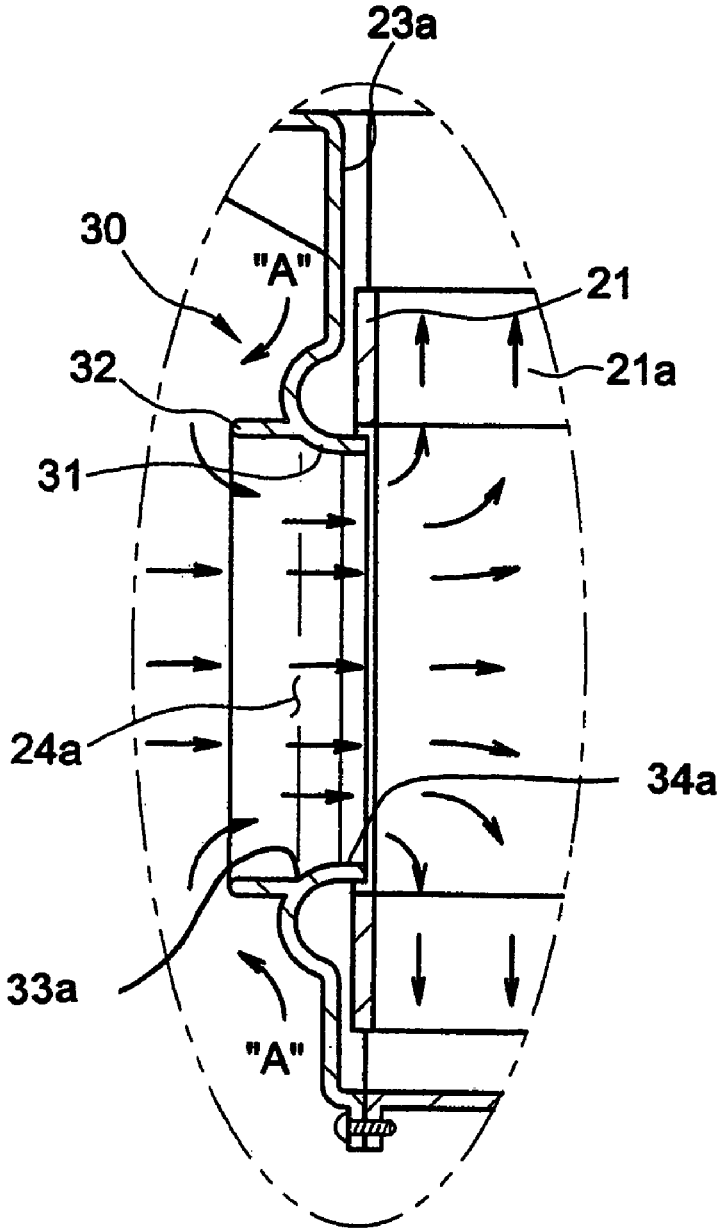
FIG. 2 is a sectional view of the portion II of FIG. 1, showing a construction of an air suction guide of the blowing device.

As shown in FIG. 2, each of the front and rear air suction guides 30 includes a rounded part 31 and a ring-shaped flow guide part 32. The rounded part 31 of each of the front and rear air suction guides 30 has a smoothly rounded surface to guide the inlet room air from an associated suction port 24*a*, 24*b* of the fan casing 23 to the blowing fan 21, and has a variable inner diameter which is gradually reduced in a direction from the suction port 24*a*, 24*b* toward the blowing fan 21. The air suction guides 30 may also be provided with a curved portion that is positioned outside the respective suction ports 24*a*, 24 *b*and that protrudes outwardly from a wall of the fan casing 23 to extend toward the ring-shaped flow guide part 32. In an exemplary. non-limiting embodiment, the curved portion may be located in the area aligned with the lead line of the air suction guide 30 shown in FIG. 2. The ring-shaped flow guide part 32 extends forward from the rounded part 31 of the air suction guide 30, so as to extend from an edge 33*a* of the suction port 24*a* by a predetermined length. The flow guide part 32 has an inner diameter which is larger than a minimum inner diameter 34*a* of the rounded part 31.

Due to the above-mentioned construction of the front and rear air suction guides 30, the ring-shaped flow guide part 32 of the air suction guide 30 restricts the flow of the inlet room air which flows from an area A outside the flow guide part 32 to the suction port 24*a* along the rounded part 31 of the air suction guide 30. Thus, the ring-shaped flow guide part 32 reduces a flowing speed of the inlet room air which flows around a portion adjacent to the rounded part 31 of the air suction guide 30. In other words, the ring-shaped flow guide part 32 restricts the flow of the inlet room air which normally tends to flow directly from the outside area A in front of the suction port 24*a* to the suction port 24*a*. Thus, the ring-shaped flow guide part 32 reduces the flowing speed of the inlet room air that flows through a peripheral area of the suction port 24*a*, which is adjacent to the air suction guide 30. Therefore, the ring-shaped flow guide part 32 reduces an amount of the inlet room air which flows to the blowing fan 21 through the peripheral area of the suction port 24*a*. Furthermore, because the ring-shaped flow guide part 32 extends forward from the rounded part 31 of the air suction guide 30 by the predetermined length, the inlet room air flows in a state of laminar flow along an inner surface of the ring-shaped flow guide part 32 while the inlet room air is drawn into the fan casing 23 through the suction port 24*a*.

Therefore, the air suction guide 30 according to the first embodiment of the present invention reduces a difference in the flowing speed between the inlet room air which flows through the central area of the suction port 24*a* and the inlet room air which flows through the peripheral area of the suction port adjacent to the air suction guide 30. The reduction in the flowing speed difference of the inlet room air between the central area and the peripheral area of the suction port 24*a* allows the inlet room air to flow through an entire area of the suction port 24*a* at flowing speeds with a minimized difference. The air suction guide 30 thus reduces a variation in a pressure applied onto the blades 21*a* of the blowing fan 21 by the inlet room air, so that operational noise of the blowing device 20 caused by the variation in the pressure is reduced.

Figure 3:
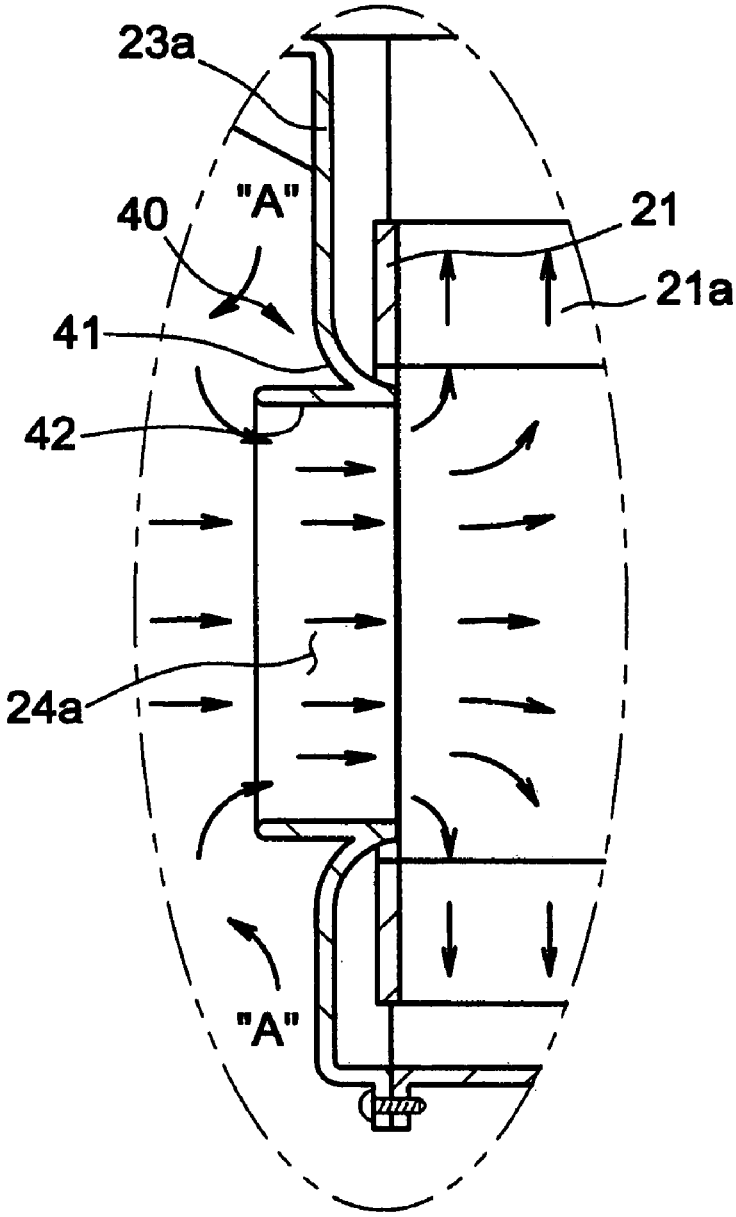
FIG. 3 is a view corresponding to FIG. 2, but showing a construction of an air suction guide according to a second exemplary embodiment of the present invention.

FIG. 3 is a view corresponding to FIG. 2, but showing a construction of an air suction guide 42 according to a second embodiment of the present invention. As shown in FIG. 3, the air suction guide 40 includes a rounded part 41 and a ring-shaped flow guide part 42. The rounded part 41 has a smoothly rounded surface with a variable inner diameter, while the ring-shaped flow guide part 42 extends forward from an end of the rounded part 41 by a predetermined length, so that the flow guide part 42 has an inner diameter which is equal to a minimum inner diameter of the rounded part 41. The ring-shaped flow guide part 42 of the second embodiment is longer than the flow guide part 41 of the first embodiment. Thus, the ring-shaped flow guide part 42 restricts the flow of the inlet room air which normally tends to flow directly from the outside area A in front of the suction port 24*a* to the suction port 24*a*. Furthermore, the ring-shaped flow guide part 42 allows the inlet room air to flow in a state of laminar flow along an inner surface of the ring-shaped flow guide part 42 while the inlet room air is drawn into the fan casing 23 through the suction port 24*a*. The air suction guide 40 of the second embodiment thus reduces a variation in a pressure applied onto the blades 21*a* of the blowing fan 21 by the inlet room air, so that operational noise of the blowing device 20 caused by the variation in the pressure is reduced.

As apparent from the above description, the present invention provides a blowing device having an air suction guide with an improved structure to reduce blowing operational noise, and an air conditioning apparatus having the blowing device. The blowing device includes a flow guide part extending forward from an edge of a suction port of a fan casing by a predetermined length. Due to the flow guide part of the air suction guide, inlet room air flows through an entire area of the suction port at a constant flowing speed and in a state of laminar flow. Therefore, the blowing device reduces a variation in a pressure applied onto blades of a blowing fan by the inlet air, and reduces the operational noise.

Although a few exemplary embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A blowing device, comprising:

a blowing fan;

a fan casing placed to cover the blowing fan and having a suction port, the fan casing having a wall that extends toward the suction port; and a suction guide provided in the suction port of the fan casing to guide inlet air to the blowing fan, the suction guide comprising a flow guide part extending forward from an edge of the suction port of the fan casing by a predetermined length and a curved portion which is positioned outside the suction port and protrudes outwardly from the wall to extend toward the flow guide part, wherein the wall merges with the suction guide such that the suction guide protrudes outwardly beyond the wall in a direction opposite a flow direction of the inlet air.

2. The blowing device according to claim 1, wherein the suction guide further comprises:

a rounded part to guide the inlet air from the suction port to the blowing fan, the rounded part having a variable inner diameter which is gradually reduced in a direction from the suction port toward the blowing fan, wherein the flow guide part extends forward from the rounded part.

3. The blowing device according to claim 2, wherein the flow guide part has an inner diameter which is larger than a minimum inner diameter of the rounded part.

4. The blowing device according to claim 1, wherein the flow guide part has an inner diameter which is uniform along the flow guide part.

5. An air conditioning apparatus, comprising:

a cabinet provided with a heat exchanger therein;

a blowing device comprising:

a blowing fan provided in the cabinet; and a fan casing placed to cover the blowing fan and having a suction port, the fan casing having a wall that extends toward the suction port; and a suction guide provided in the suction port of the fan casing to guide inlet air to the blowing fan, the suction guide comprising a flow guide part extending forward from an edge of the suction port of the fan casing by a predetermined length and a curved portion which is positioned outside the suction port and protrudes outwardly from the wall to extend toward the flow guide part, wherein the wall merges with the suction guide such that the suction guide protrudes outwardly beyond the wall in a direction opposite a flow direction of the inlet air.

6. The air conditioning apparatus according to claim 5, wherein the suction guide further comprises:

a rounded part to guide the inlet air from the suction port to the blowing fan, the rounded part having a variable inner diameter which is gradually reduced in a direction from the suction port toward the blowing fan, wherein the flow guide part extends forward from the rounded part.

7. The air conditioning apparatus according to claim 6, wherein the flow guide part has an inner diameter which is larger than a minimum inner diameter of the rounded part.

8. The air conditioning apparatus according to claim 5, wherein the flow guide part has an inner diameter which is uniform along the flow guide part.

* * * * *